US011517177B2

(12) United States Patent
Kessler et al.

(10) Patent No.: US 11,517,177 B2
(45) Date of Patent: Dec. 6, 2022

(54) DOSING METHOD FOR A DISPENSING MODULE

(71) Applicant: Henkel AG & Co. KGaA, Duesseldorf (DE)

(72) Inventors: Arnd Kessler, Monheim am Rhein (DE); Thomas Weber, Weimar (DE); Johannes Zipfel, Amsterdam (NL); Christian Nitsch, Duesseldorf (DE); Lars Zuechner, Langenfeld (DE); Nadine Franke, Cologne (DE); Georg Wawer, Vienna (AT); Alexander Mueller, Monheim (DE)

(73) Assignee: HENKEL AG & CO. KGAA, Duesseldorf (DE)

( * ) Notice: Subject to any disclaimer, the term of this patent is extended or adjusted under 35 U.S.C. 154(b) by 234 days.

(21) Appl. No.: 16/469,565

(22) PCT Filed: Dec. 7, 2017

(86) PCT No.: PCT/EP2017/081852
§ 371 (c)(1),
(2) Date: Jun. 13, 2019

(87) PCT Pub. No.: WO2018/114360
PCT Pub. Date: Jun. 28, 2018

(65) Prior Publication Data

US 2019/0387952 A1 Dec. 26, 2019

(30) Foreign Application Priority Data

Dec. 21, 2016 (DE) ..... 10 2016 225 887.7

(51) Int. Cl.
*A47L 15/44* (2006.01)
*A47L 15/00* (2006.01)
(Continued)

(52) U.S. Cl.
CPC ..... *A47L 15/449* (2013.01); *A47L 15/0055* (2013.01); *D06F 33/30* (2020.02);
(Continued)

(58) Field of Classification Search
None
See application file for complete search history.

(56) References Cited

U.S. PATENT DOCUMENTS

2007/0044820 A1 3/2007 Chan et al.
2009/0126123 A1 5/2009 Kim et al.
(Continued)

FOREIGN PATENT DOCUMENTS

CA 2954248 A1 1/2016
CN 103266452 A 8/2013
(Continued)

OTHER PUBLICATIONS

DE-102007014425 English Translation, accessed on Mar. 2021. (Year: 2008).*
(Continued)

*Primary Examiner* — Eric W Golightly
*Assistant Examiner* — Arlyn I Rivera-Cordero
(74) *Attorney, Agent, or Firm* — Lorenz & Kopf, LLP

(57) ABSTRACT

The disclosure relates to a method including capturing and/or obtaining a reservoir information item at a dispensing module for a detergent and/or cleaning agent, with the reservoir information item representative of at least one property of a reservoir for the detergent and/or cleaning agent, an application specification for the detergent and/or cleaning agent contained in the reservoir, and/or a property of the detergent and/or cleaning agent contained in the reservoir, and the reservoir is connected or connectable to the dispensing module. The method further includes determining and/or causing the determination of a dispensing
(Continued)

control information item depending at least in part on the reservoir information item, with the dispensing control information item configured to at least partly control the dispensing of the detergent and/or cleaning agent by the dispensing module.

8 Claims, 6 Drawing Sheets

(51) Int. Cl.

| | |
|---|---|
| ***D06F 39/02*** | (2006.01) |
| ***D06F 33/30*** | (2020.01) |
| ***D06F 34/05*** | (2020.01) |
| *D06F 103/00* | (2020.01) |
| *D06F 103/22* | (2020.01) |
| *D06F 105/42* | (2020.01) |

(52) U.S. Cl.
CPC ..... *D06F 39/02* (2013.01); *A47L 2501/07* (2013.01); *D06F 34/05* (2020.02); *D06F 39/022* (2013.01); *D06F 2103/00* (2020.02); *D06F 2103/22* (2020.02); *D06F 2105/42* (2020.02)

(56) References Cited

U.S. PATENT DOCUMENTS

| | | | |
|---|---|---|---|
| 2009/0194562 | A1 | 8/2009 | Kessler et al. |
| 2010/0132748 | A1 | 6/2010 | Kessler et al. |
| 2010/0186460 | A1 | 7/2010 | Boeldt et al. |
| 2013/0175293 | A1 | 7/2013 | Burgess |
| 2017/0205791 | A1 | 7/2017 | Yang et al. |

FOREIGN PATENT DOCUMENTS

| | | | | | |
|---|---|---|---|---|---|
| DE | 102006026800 | A1 | | 12/2007 | |
| DE | 102006038341 | A1 | | 2/2008 | |
| DE | 102007014425 | A1 | * | 9/2008 | ..... A47L 15/4454 |
| DE | 102007014425 | A1 | | 9/2008 | |
| DE | 102008005363 | A1 | | 10/2008 | |
| DE | 102008028253 | A1 | | 1/2009 | |
| DE | 102010028483 | A1 | | 11/2011 | |
| DE | 102014002560 | A1 | | 8/2015 | |
| DE | 102015107695 | A1 | | 11/2016 | |
| EP | 2368645 | B1 | * | 10/2012 | ..... B08B 3/08 |
| WO | 02029150 | A1 | | 4/2002 | |

OTHER PUBLICATIONS

DE10200638341 English Translation, accessed Jun. 2021. (Year: 2008).*

EP-2368645-B1 English Translation, accessed on Dec. 2021. (Year: 2012).*

CN103266452 English Translation, accessed on Apr. 2022. (Year: 2013).*

EPO, International Search Report and Written Opinion issued in International Application No. PCT/EP2017/081852, dated Jan. 30, 3018, 12 pages.

* cited by examiner

DOSING METHOD FOR A DISPENSING MODULE

CROSS-REFERENCE TO RELATED APPLICATIONS

This application is a U.S. National-Stage entry under 35 U.S.C. § 371 based on International Application No. PCT/EP2017/081852, filed Dec. 7, 2017, which was published under PCT Article 21(2) and which claims priority to German Application No. 10 2016 225 887.7, filed Dec. 21, 2016, which are all hereby incorporated in their entirety by reference.

TECHNICAL FIELD

The present disclosure relates primarily to a method and a device for dispensing measured quantities of detergent and/or cleaning agent.

BACKGROUND

When detergent and/or cleaning agent from different reservoirs are used in a washing and/or cleaning process, appropriate dosages must be selected for the detergent and/or cleaning agent contained in each of the one or more reservoirs. The selection is usually made by the user, and entered for example at a user interface of a washing or cleaning machine. In these instances, either mistakes can be made when the user makes the entries or it is possible that the user simply does not have the information necessary to select the correct dosage.

SUMMARY

One object of the present disclosure is therefore to overcome the problems described, and for example to simplify the work steps needed to carry out washing and/or cleaning processes, and to enable the measured dispensing of detergent and/or cleaning agent to be carried out in a user-friendly, convenient manner.

According to a first aspect of the present disclosure, a method is disclosed wherein the method comprises:

capturing and/or obtaining reservoir information item at a dispensing module for a detergent and/or cleaning agent, wherein the reservoir information item is representative of at least one property of a reservoir for the detergent and/or cleaning agent, an application specification for the detergent and/or cleaning agent contained in the reservoir, and/or a property of the detergent and/or cleaning agent contained in the reservoir, and wherein the reservoir is connected and/or connectable to the dispensing module; and determining and/or causing the determination of dispensing control information item depending at least partly on the reservoir information, wherein the dispensing control information item is configured to at least partly control a dispensing of the detergent and/or cleaning agent by the dispensing module.

The method according to the first aspect of the present disclosure is for example a method for dispensing detergents and/or cleaning agents.

Further according to the first aspect of the present disclosure, a dispensing module for detergents and/or cleaning agents is disclosed which is configured to carry out and/or control the steps of the method according to the first aspect of the present disclosure or comprising respective features for carrying out and/or controlling the steps of the method according to the first aspect of the present disclosure.

In this context, either all the steps of the method according to the first aspect of the present disclosure may be controlled by the features, or all the steps of the method according to the first aspect of the present disclosure may be carried out by the features, or one or more or one or more steps is/are controlled by the features and one or more steps is/are carried out by the features. Different steps may optionally be carried out or controlled by different features.

The features of the dispensing module according to the first aspect of the present disclosure may comprise hardware and/or software components. The features may comprise for example at least one memory with software instructions of a computer program (e.g., of the computer program according to the first aspect of the present disclosure) and at least one processor designed to execute software instructions from the at least one memory. On the basis of the above, according to the first aspect of the present disclosure a dispensing module comprising at least one processor and at least one memory with software instructions, wherein the at least one memory and the software instructions are configured together with the at least one processor to cause the dispensing module to carry out and/or control the method according to the first aspect of the present disclosure is also to be considered disclosed.

Alternatively or additionally, the features may also comprise one or more sensors and/or one or more communication interfaces.

A communication interface is understood to be for example a wireless communication interface and/or a wired communication interface.

A wireless communication interface is for example a communication interface based on wireless communication technology. An example of a wireless communication technology is a local wireless network technology such as Radio Frequency Identification (RFID) and/or Near Field Communication (NFC) and/or Bluetooth (e.g., Bluetooth Version 2.1 and/or 4.0) and/or Wireless Local Area Network (WLAN). RFID and NFC are specified for example according to the ISO standards 18000, 11784/11785 and the ISO/IEC standards 14443-A and 15693. The Bluetooth specifications are now available on the internet at www.bluetooth.org. WLAN is specified for example in the standards of the IEEE-802.11 family. A further example of a wireless communication technology is a regional wireless network technology such as for example a mobile phone technology, such as Global System for Mobile Communications (GSM) and/or Universal Mobile Telecommunications System (UMTS) and/or Long Term Evolution (LTE). The GSM, UMTS and LTE specifications are maintained and developed by the 3rd Generation Partnership Project (3GPP) and are currently available on the internet at www.3gpp.com and elsewhere.

A wired communication interface is for example a communication interface according to a wired communication technology. Examples of a wired communication technology are a Local Area Network (LAN) and/or a bus system, for example a Controller Area Network bus (CAN-Bus) and/or a Universal Serial Bus (USB). CAN bus is specified for example according to the ISO standard ISO 11898. The USB specifications are currently available on the internet at www.usb.org. LAN specified in the standards of the IEEE-802.3 family, for example.

Of course, the dispensing module may also comprise other features not listed above.

For example, the dispensing module according to the first aspect of the present disclosure is understood to be an apparatus for example. The dispensing module according to the first aspect of the present disclosure is for example a dispensing module for dispensing detergents and/or cleaning agents.

Further according to the first aspect of the present disclosure, a computer program is disclosed which comprises software instructions designed to instruct an apparatus to carry out and/or control the method according to the first aspect when the computer program is executed by a processor.

Further according to the first aspect of the present disclosure, a computer-readable storage medium which contains a computer program according to the first aspect of the present disclosure is disclosed. A computer-readable storage medium may be embodied for example as a magnetic, electric, electromagnetic, optical, or as some other kind of storage medium. Such a computer-readable storage medium is preferably real (i.e. "tangible"), for example it is embodied as a data carrier apparatus. Such a data carrier apparatus is for example portable or permanently installed in an apparatus. Examples of such a data carrier apparatus are volatile or non-volatile memories with random access (RAM) such as for example NOR flash memories, or with sequential access such as NAND flash memories and/or memories with read-only access (ROM) or read-write access. In this context, the term computer-readable denotes for example that the storage medium can be read (output) and/or written to by a computer or server apparatus, by a processor for example.

According to a second aspect of the present disclosure, a method is disclosed, wherein the method comprises:

receiving a reservoir information item at a server apparatus, wherein the reservoir information item is representative of at least one property of a reservoir for a detergent and/or cleaning agent, an application specification for the detergent and/or cleaning agent contained in the reservoir, and/or a property of the detergent and/or cleaning agent contained in the reservoir, wherein the reservoir is connected or connectable to a dispensing module for the detergent and/or a cleaning agent;

determining a dispensing control information item by the server apparatus depending at least partly on the reservoir information item, wherein the dispensing control information item is configured to at least partly control the dispensing of the detergent and/or cleaning agent by the dispensing module; and sending the dispensing control information item from the server apparatus to the dispensing module.

The method according to the second aspect of the present disclosure is for example a method for determining a dispensing control information item.

Further according to the second aspect of the present disclosure, a server apparatus is disclosed which is configured to execute and/or control the steps of the method according to the second aspect of the present disclosure, or comprises respective features for executing and/or controlling the steps of the method according to the second aspect of the present disclosure. In this context, the term server apparatus is understood to refer to a single server or also multiple servers connected operatively to each other, such as a server cloud for example.

In this context, either all steps of the method according to the second aspect of the present disclosure may be controlled by the features, or all steps of the method according to the second aspect of the present disclosure may be executed by the features, or one or more steps may be controlled by the features and one or more steps may be executed by the features. Different steps may optionally be executed or controlled by different features.

The features of the server apparatus according to the second aspect of the present disclosure may comprise hardware and/or software components. The features may comprise for example at least a memory with software instructions of a computer program (e.g., the computer program according to the second aspect of the present disclosure) and at least one processor designed to execute software instructions from the at least one memory. Accordingly, a server apparatus comprising at least one processor and at least one memory with software instructions, wherein the at least one memory and the software instructions are configured together with the at least one processor to instruct the server apparatus to execute and/or control the method according to the second aspect of the present disclosure, should be considered disclosed according to the second aspect of the present disclosure.

Alternatively or additionally, the features of the server apparatus according to the second aspect of the present disclosure may further comprise one or more communication interfaces (e.g., one or more wireless communication interfaces and/or one or more wire-connected communication interfaces). Of course, the server apparatus may also comprise other features not listed here.

The server apparatus according to the second aspect of the present disclosure is for example a server apparatus for communication with one or more dispensing modules (e.g., the dispensing module according to the first aspect of the present disclosure).

In addition, a computer program comprising software instructions that are designed to instruct an apparatus to execute and/or control the method according to the second aspect of the present disclosure when the computer program is run by a processor is also disclosed according to the second aspect of the present disclosure.

Further, a computer-readable storage medium including a computer program according to the second aspect of the present disclosure is disclosed according to the second aspect of the present disclosure. The preceding disclosure of a computer-readable storage medium in conjunction with the first aspect of the present disclosure is also intended to extend to a computer-readable storage medium according to the second aspect of the present disclosure.

In the following text, the features of the methods according to the first aspect of the present disclosure and according to the second aspect of the present disclosure, of the dispensing module according to the first aspect of the present disclosure, of the server apparatus according to the second aspect of the present disclosure and of the computer programs according to the first aspect of the present disclosure and according to the second aspect of the present disclosure will be described, in some cases with reference to examples thereof.

The idea of capturing a reservoir information item is understood for example to mean that a reservoir information item is captured by the dispensing module or by a feature of the dispensing module. As disclosed below, capture of the reservoir information item may be performed by a sensor of the dispensing module, for example.

Accordingly, the idea of obtaining a reservoir information item is understood for example to mean that the reservoir information item is obtained by the dispensing module or by a feature(s) of the dispensing module. For example, the idea of obtaining the reservoir information item is intended to extend to receiving and/or reading out the reservoir information item by the dispensing module or a communication interface of the dispensing module.

The reservoir information item represents for example a characteristic property of the reservoir. A reservoir information item which is characteristic of a property of a reservoir is understood to be for example an information item which represents and/or contains one or more indicators regarding a maximum date of use of the reservoir, regarding the spatial configuration of the reservoir, regarding a volume and/or fill quantity of the reservoir, and/or for identifying the reservoir or the reservoir type.

The reservoir information item may also represent an application specification for a detergent and/or cleaning agent contained in the reservoir. Such an application specification contains and/or represents for example one or more indicators regarding a recommended dosage of the detergent and/or cleaning agent for a given application. Alternatively or additionally, a reservoir information item that represents an application specification for a detergent and/or cleaning agent contained in the reservoir is also understood to extend to an information item which identifies the dispensing control information item and/or represents and/or contains at least a part of the dispensing control information item.

Alternatively or additionally, the reservoir information item represents a property of a detergent and/or cleaning agent contained in the reservoir. Such a reservoir information item which is characteristic of a property of a detergent and/or cleaning agent contained in a reservoir is understood to be for example an information item which represents or contains one or more indicators regarding a chemical and/or physical property of the detergent and/or cleaning agent, regarding the type of the detergent and/or cleaning agent and/or for identifying the detergent and/or cleaning agent. In this context, a chemical and/or physical property of the detergent and/or cleaning agent is understood to be a chemical and/or physical composition of the detergents and/or of the aggregate state of the washing and/or cleaning agent (e.g., solid, liquid or gaseous). For example, the reservoir information item represents the values of one or more physical and/or chemical variables (e.g., one or more values of physical and/or chemical variables which describe one or more properties of the washing and/or cleaning agent contained). An indicator of a type of detergent and/or cleaning agent specifies for example whether it is a detergent which contains bleach, a mild detergent, a detergent for coloured fabrics, a disinfectant, a machine-dishwashing detergent and/or another type of detergent and/or cleaning agent, and/or what ingredients and/or structural composition the detergent and/or cleaning agent contains. An example of an indicator for identifying the detergent and/or cleaning agent is for instance an identifier for identifying the detergent and/or cleaning agent such as a product name and/or a product number.

The reservoir is designed to accommodate a detergent and/or cleaning agent (e.g., a certain quantity of a detergent and/or cleaning agent), for example. The reservoir has for example one or more storage chambers to accommodate detergent and/or cleaning agent. If the reservoir has multiple storage chambers, each of the storage chambers may contain a different detergent and/or cleaning agent and/or a different detergent and/or cleaning agent mixture, for example. The reservoir may be constructed with a certain spatial form, for example (e.g., in the shape of a cube, a ball and/or a plate). At least part of the reservoir for example may be of rigid construction. Alternatively or additionally, at least part of the reservoir for example may be of flexible construction, in the form of flexible packaging material, for example (e.g., as a tube and/or a pouch). Of course, the reservoir may also be constructed as an at least partially flexible receptacle surrounded by an at least partially rigid holding receptacle, for example as a pouch in a substantially dimensionally stable frame.

The detergent and/or cleaning agent is accommodated in the reservoir in solid, liquid and/or gaseous form, for example. The detergent and/or cleaning agent is for example a pure substance and/or a mixture of substances. A solid detergent and/or cleaning agent may be accommodated in the reservoir in the form for example of a powder, a tablet and/or a tab. A liquid detergent and/or cleaning agent may be contained in the reservoir for example as a gel, as concentrated and/or diluted solution. Of course, the detergent and/or cleaning agent may also be contained in the reservoir as foam, as hard foam, as emulsion, as suspension and/or as aerosol. Examples of detergents and/or cleaning agents and/or their ingredients include but are not limited to one or more components from a group including surfactants, alkalis, builders, greying inhibitors, optical brighteners, enzymes, bleaches, soil-release polymers, fillers, fabric softeners, fragrances, dyes, care substances, acids, starch, isomalt, sugar, cellulose, cellulose derivatives, carboxymethyl cellulose, polyetherimide, silicone derivatives, and/or polymethylimine. An exemplary list of further components includes but is not limited to bleach activators, chelating agents, structural materials, electrolytes, non-aqueous solvents, pH adjusters, perfume carriers, fluorescing agents, hydrotropes, silicone oils, bentonite, anti-redeposition agents, anti-shrink agents, anti-creasing agents, dye transfer inhibitors, antimicrobial agents, germicides, fungicides, antioxidants, preservatives, corrosion inhibitors, antistatic agents, buttering agents, ironing aids, soil repellents or impregnating agents, anti-swelling or anti-slip substances, and/or UV absorbers. A further exemplary list of components includes but is not limited to one or preferably more substances from the group of builders, polymers, bleaches, bleach activators, bleach catalysts, enzymes, thickeners, sequestering agents, electrolytes, corrosion inhibitors, glass corrosion inhibitors, anti-foaming agents, dyes, additives for improving outflow and drying behaviour, disintegration aids, preservatives, pH-adjusting agents, fragrances, and perfume carriers.

The use of builder substances such as silicates, aluminium silicates (particularly zeolites), salts of organic di- and polycarboxylic acids and mixtures of these substances, preferably water-soluble builder substances, may be advantageous.

In a preferred variant as contemplated herein, the use of phosphates (and polyphosphates) is largely or completely avoided. In this variant, the substance contains less than 5% by weight, particularly preferably less than 3% by weight, in particular less than 1% by weight phosphate(s). In this variant, the substance is most particularly preferably entirely free of phosphates, i.e. the substances contain less than 0.1% by weight phosphate(s).

The builders include in particular carbonates, citrates, phosphonates, organic structural agents and silicates. The proportion by weight of the structural agents in the overall weight of substances as contemplated herein is preferably from about 15 to about 80% by weight and particularly from about 20 to about 70% by weight.

Preferred cleaning agents, in particular substances for use in machine dishwashers, are exemplified by a structural combination of citrate and carbonate and/or bicarbonate.

Anionic, non-ionic, cationic and amphoteric surfactants are suitable for use as surfactants. Surfactants are selected according to the intended purpose of the composition.

Suitable anionic surfactants are in particular soaps, particularly those which contain sulfate or sulfonate groups. $C_9$-$C_{13}$-alkylbenzene sulfonates, olefin sulfonates, that is to say mixtures of alkene and hydroxyalkane sulfonates and disulfonates, such as are obtained for example from C12-C18 monoolefins with terminal or internal double bond by sulfonating with gas-phase sulfur trioxide and subsequent alkaline or acidic hydrolysis of the products of sulfonation are preferred candidates for use as surfactants of the sulfonate type. Alkane sulfonates obtained from $C_{12}$-$C_{18}$-alkanes for example by sulfochlorination or sulfoxidation with subsequent hydrolysis or neutralisation are also suitable. The esters of α-sulfofatty acids (ester sulfonates), for example the α-sulfonated methylesters of hydrogenated coconut, palm nut or tallow fatty acids produced by α-sulfonation of the methylesters of vegetable- and/or animal-based fatty acids having 8 to 20 C atoms in the fatty acid molecule followed by neutralisation to form water-soluble monosalts are eligible.

Suitable non-ionic surfactants are in particular alkyl glycosides and ethoxylation and/or propoxylation products of alkyl glycosides or of linear or branched alcohols, each having 12 to 18 C atoms in the alkyl part and 3 to 20, preferably 4 to 10 alkylether groups. Corresponding ethoxylation and/or propoxylation products of N-alkyl-amines, vicinal diols, fatty acid esters, and fatty acid amides which correspond to the long-chain alcohol derivatives in respect of the alkyl part, and of alkylphenols having 5 to 12 C atoms in the alkyl radical are also usable.

Examples of cationic surfactants are quaternary ammonium compounds and esterquats, in particular quaternised fatty acid trialkanol amine ester salts.

Typical examples of amphoteric or zwitterionic surfactants are alkyl betaine, alkyl amidobetaine, aminopropionates, aminoglycinates, imidazolinium betaine, and sulfobetaine.

The reservoir is and/or can be connected to the dispensing module, for example. The reservoir is preferably connected detachably to the dispensing module and/or can be connected detachably to the dispensing module. A detachable connection is for example a connection in which the reservoir and the dispensing module can be attached and separated non-destructively. For example, more than one reservoir is/are and/or can be connected to the dispensing module. For example, the reservoir may be connected and/or connectable to the dispensing module mechanically. For example, the dispensing module and the reservoir have corresponding connecting features for creating a connection between the reservoir and the dispensing module. The connection may be for example a positive connection, for example in the form of a detent mechanism. Alternatively or additionally, the connection may be a force-fitting connection, for example in the form of a screwed and/or hook and eye connection. In another alternative, the connection may be materially bonded connection for example in the form of an adhesive connection.

The connection between the reservoir and the dispensing module may further serve to transport the detergent and/or cleaning agent from the reservoir into the dispensing module. For example, the connection features are designed to create a liquid-tight, vapour-tight and/or gas-tight connection for transporting the detergent and/or cleaning agent from the reservoir into the dispensing module. Examples of connecting features for creating such a connection are a cannula (e.g., a cannula of the reservoir) and a membrane (e.g., a membrane of the dispensing module) and/or Luer connector and/or Luer fittings.

If more than one reservoir is connected and/or connectable to the dispensing module at the same time, alternatively or additionally the reservoirs may also be connected and/or connectable to tach other. For example, at least those reservoirs which are connected to the dispensing module may also be connected and/or connectable to each other.

The dispensing control information item specifies one or more dispensing parameters for example. Examples of a dispensing parameter are a quantity to be dispensed, a time at which dispensing is to take place, a dispensing temperature, and/or a period of time for which dispensing is to take place. For example, a dispensing parameter specifies a dispensing quantity, a dispensing time, a dispensing temperature, and/or a dispensing duration for delivery of detergent and/or cleaning agent. The fact that the dispensing control information item is configured so that the delivery of a detergent and/or cleaning agent is to be at least partly controlled by the dispensing module is understood to mean for example that the dispensing control information item causes the dispensing module to dispense the detergent and/or cleaning agent according to the dispensing parameters predetermined by the dispensing control information item.

Determination of the dispensing control information item at least partly on the basis of the reservoir information item is understood to mean for example that the dispensing control information item is selected and/or calculated at least partly depending on the reservoir information item. For example, the dispensing control information item is determined by the dispensing module.

Alternatively or additionally, the dispensing control information item may also be determined by an apparatus other than the dispensing module (e.g., the server apparatus).

Accordingly, causing dispensing control information items to be determined is understood to mean for example that the dispensing module causes the dispensing control information item to be determined by an apparatus other than the dispensing module (e.g., the server apparatus). For example, the reservoir information item is transmitted to the server apparatus by the dispensing module in order to cause the dispensing control information item to be determined by the server apparatus.

Sending a reservoir information item by the dispensing module is understood to mean for example that the reservoir is sent by the dispensing module or by a feature(s) of the dispensing module (e.g., by a communication interface of the dispensing module).

Then, the reservoir information item is received for example at the server apparatus. Receiving a reservoir information item at the server apparatus is understood to mean for example that the reservoir information item is received by the server apparatus or by a feature(s) of the server apparatus (e.g., by a communication interface).

Then, depending at least partly on the reservoir information item received at the server apparatus, the server apparatus for example determines the dispensing control information item and sends the dispensing control information item from the server apparatus to the dispensing module.

Sending a dispensing control information item from the server apparatus to the dispensing module is understood to mean for example that the dispensing control information item is sent to the dispensing module by the server apparatus or by a feature(s) of the server apparatus (e.g., by a communication interface).

In this way, according to the present disclosure, a suitable dispensing control information item may be determined for a reservoir information item in particularly user-friendly manner, and quickly, to enable particularly efficient dispensing (e.g., dosing) of detergent and/or cleaning agent by the dispensing module. Thus for example the consumption of detergent and/or cleaning agent, for example may be reduced and at the same time an optimal washing and/or cleaning result achieved without any action on the part of the user. Moreover, for example individual, for example different reservoirs may by combined freely with each other, and for example it may be possible to adjust a washing and/or cleaning chemistry freely to the programs used.

According to an exemplary embodiment according to the first aspect of the present disclosure, the method according to the first aspect of the present disclosure further includes for example dispensing and/or causing a detergent and/or cleaning agent to be dispensed by the dispensing module depending at least in part on the dispensing control information item.

Dispensing a detergent and/or cleaning agent is understood for example to mean that the detergent and/or cleaning agent is delivered to the area surrounding the dispensing module and/or of the reservoir. Dispensing is carried out for example by the dispensing module. Alternatively or additionally, dispensing may be caused by the dispensing module, e.g., the dispensing module causes the detergent and/or cleaning agent to be dispensed by the reservoir. For example, the detergent and/or cleaning agent is dispensed to the area surrounding the dispensing module and/or of the reservoir through a dispensing aperture in the dispensing module and/or in the reservoir.

As was disclosed earlier, the dispensing control information item may specify one or more dispensing parameters. For example, the dispensing module is configured to dispense the detergent and/or cleaning agent contained in the reservoir according to the dispensing parameters specified by the dispensing control information item, and/or to cause dispensing of the detergent and/or cleaning agent contained in the reservoir (e.g., by the reservoir) according to the dispensing parameters specified by the dispensing control information item when the reservoir is connected to the dispensing module (e.g., only when the reservoir is connected to the dispensing module).

For example, the dispensing module comprises a control unit and at least one actuator, wherein the control unit is configured to control the actuator. For example, the control unit is configured to control the actuator in such manner as to cause a movement of the actuator. For example, the movement of the actuator causes a detergent and/or cleaning agent to be dispensed. For example, the control unit is configured to control the actuator in such manner that the detergent and/or cleaning agent is dispensed according to the dispensing parameters specified by the dispensing control information item and/or dispensing of the detergent and/or cleaning agent contained in the reservoir is caused (e.g., by the reservoir) according to the dispensing parameters specified by the dispensing control information item.

An actuator is understood to be a displaceable component of the dispensing module. For example, the actuator is configured in such manner that when it moves and the reservoir is connected to the dispensing module, this causes the detergent and/or cleaning agent to be dispensed. Examples of an actuator are a pump (e.g., a peristaltic pump), a valve and/or a motor (e.g., a linear motor). If the actuator is a pump, the control unit controls the pump for dispensing the detergent and/or cleaning agent for example in such manner that the pump transports the detergent and/or cleaning agent from the reservoir to a dispensing aperture (e.g., a dispensing aperture of the reservoir and/or of the dispensing module). If the actuator is a valve, the valve is configured for example to close a dispensing aperture (e.g., a dispensing aperture of the reservoir and/or of the dispensing module). In order to dispense the detergent and/or cleaning agent, the control unit actuates the valve for example in such manner that the valve opens, enabling the detergent and/or cleaning agent to flow out through the dispensing aperture.

For example the dispensing module according to the first aspect of the present disclosure additionally comprises at least one power supply feature. The at least one power supply feature is configured for example to supply the actuator and/or the control unit with power. Alternatively or additionally, the at least one power supply feature may be included in a reservoir (e.g., a reservoir which is connected and/or connectable to the dispensing module) for example.

The at least one power supply feature is for example designed to supply power which is appropriate for operating the dispensing module. For example, the power supply feature comprises one or more electrical energy sources. An exemplary electrical energy source is a battery, a rechargeable battery, a power supply unit, a capacitor, and/or a solar cell. For example, the power supply feature is designed such that the dispensing module is autarchic, in particular independent of an external power supply. For example, the power supply feature is designed to be replaceable, for example in the form of a replaceable battery. The power supply feature is for example liquid-tight, in particular water-tight. Alternatively or additionally, the power supply feature may comprise at least one mechanical energy source, for example a helical spring, a torsion spring (e.g., a torsion bar), a bending spring, a gas pressure spring (e.g., an air spring), and/or an elastomer spring.

According to an exemplary embodiment according to the first aspect of the present disclosure, the reservoir information item is captured by feature(s) of at least one sensor of the dispensing module.

A sensor is understood to be for example a mechanical sensor (e.g., a pressure sensor) and/or an optical sensor (e.g., a CCD sensor). Besides an optical sensor, the dispensing module may further comprise a light generating feature which is designed to generate light in the visible and/or in the non-visible range. An example of a light generating feature is a light emitting diode (LED).

For example, the reservoir information item is provided in the form of an optically and/or mechanically detectable pattern. With such a pattern, the reservoir information item may be represented efficiently and permanently. Moreover, such a pattern is particularly unsusceptible to external influences (e.g., mechanical damage and/or chemical degradation).

A detectable pattern is understood to be for example a pattern which is detectable by a sensor (e.g., the sensor of the dispensing module). For example, the pattern is a part of the reservoir and/or is arranged on the reservoir (e.g., printed on the reservoir, and/or attached and/or applied adhesively to the reservoir in the form of a sticker or label). The pattern is located for example in at least substantially the same spatial position on more than one reservoir. The position may be for example a predetermined position.

The pattern is for example an optically detectable pattern (i.e. a pattern which can be detected by an optical sensor). Examples of an optical pattern are strings of letters and/or numbers, geometrical patterns, barcodes, quick response codes (QR codes) and/or 2D codes.

Alternatively or additionally, the pattern may also be a mechanically detectable pattern (i.e. a pattern which can be detected by a mechanical sensor). Examples of a mechanical pattern are dot patterns formed mechanically on the surface of the reservoir (e.g., Braille characters) and/or detent elements in a distinctive arrangement.

According to an exemplary embodiment according to the first aspect of the present disclosure, receipt of the reservoir information item is assured by a communication interface of the dispensing module. For example, the communication interface of the dispensing module is a wireless communication interface. The wireless communication interface of the dispensing module is for example a communication interface according to a wireless local communication technology such as a Bluetooth interface, a WLAN interface, a RFID interface, and/or a NFC interface.

The reservoir information item is made available for example via a communication interface of the reservoir. For example, the wireless communication interface of the reservoir is a communication according to a wireless local communication technology such as a Bluetooth interface, a WLAN interface, a RFID interface, and/or a NFC interface. For example, the reservoir comprises an information medium which represents the reservoir with a memory and a communication interface, wherein the reservoir information item is stored in the memory, and wherein the reservoir information item may be read out of the memory via the communication interface of the reservoir. For example, the communication interface of the dispensing module is configured to read the reservoir information item represented by the information medium of the reservoir out of the information medium memory via the communication interface of the reservoir. The information medium is for example a part of the reservoir and/or is arranged on the reservoir (e.g., attached and/or mounted adhesively on the reservoir in the form of a sticker or label). The information medium is located for example in at least substantially the same spatial position on more than one reservoir. The position may be for example a predetermined position.

The information medium representing the reservoir information item is for example a tag and/or label which can be read out. A tag and/or label which can be read out is understood to be for example a tag and/or label which can be read out by a communication interface (e.g., the communication interface of the dispensing module). Examples of a tag and/or label which can be read out are RFID tags, RFID labels, NFC tags, and/or NFC labels. The tag and/or label which can be read out is preferably a tag and/or label which can be read out passively. A tag and/or label which can be read out passively enables the reservoir information item to be read via a communication interface without having to provide the tag and/or label its own energy source.

According to an exemplary embodiment according to the first aspect of the present disclosure, the dispensing control information item is determined from a multiplicity of specified dispensing control information item, at least some of which is dependent on the reservoir information item. In this way, for example, dispensing control information item corresponding to the reservoir information item may be determined as effectively as possible.

For example, the dispensing control information item is selected from a multiplicity of specified dispensing control information item depending at least in part on the reservoir information item. Each of the multiplicity of specified dispensing control information item may be assigned for example to a reservoir information item, so that the dispensing control information item to which the received and/or captured reservoir information item is assigned is selected in each case. For example, the dispensing control information item may be determined by the dispensing module and/or by the server apparatus at least partly depending on the reservoir information item.

According to an exemplary embodiment according to the first aspect of the present disclosure, the method according to the first aspect of the present disclosure may further comprise for example keeping available the information item which represents the multiplicity of specified dispensing control information items.

Information representing the multiplicity of specified dispensing control information items is understood to be kept available by the dispensing module for example when it is stored in a memory of the dispensing module. This enables the dispensing module to access the information representing the multiplicity of specified dispensing control information items directly, without the need to establish a communication link, for example. The idea of keeping available information that represents the multiplicity of specified dispensing control information items is understood to mean for example that the information is made available for retrieval. Alternatively or additionally, information representing the multiplicity of specified dispensing control information items may be understood to be kept available by the server apparatus if it is stored in a memory of the server apparatus. In this case, the dispensing module does not need a dedicated memory for the multiplicity of specified dispensing control information items, for example.

The method according to the first aspect of the present disclosure comprises for example capturing and/or obtaining a washing and/or cleaning information item at the dispensing module and adjusting at least one dispensing control information item from the multiplicity of specified dispensing control information items depending a least partly on the washing and/or cleaning information item. Obtaining washing and/or cleaning information items and adjusting the dispensing control information item depending at least partly thereon makes it possible to respond flexibly and individually to a change (e.g., a change in the chemical environment).

The washing and/or cleaning information item represents for example measurement values for one or more physical and/or chemical variables which are characteristic of a washing and/or cleaning operation, such as a temperature of the washing and/or cleaning solution, a duration of the washing and/or cleaning process and/or a concentration of detergent and/or cleaning agent in washing and/or cleaning solution. For example, the washing and/or cleaning information item may be a washing and/or cleaning information item which was captured during a washing and/or cleaning process, in the course of which a detergent and/or cleaning agent was dispensed according to a dispensing control information item determined by the dispensing module.

The capture of the washing and/or cleaning information item at the dispensing module is carried out for example by a sensor of the dispensing modules.

The obtaining of the washing and/or cleaning information item is understood to mean for example obtaining (e.g., receiving via a communication interface of the dispensing module) an item of washing and/or cleaning information captured by an external sensor. Such an external sensor may be for example a part of a washing and/or cleaning machine which is configured to capture measurement values of physical and/or chemical variables that are characteristic of the washing and/or cleaning operation during a washing and/or cleaning operation performed by the washing and/or cleaning machine.

The adjustment of at least one of the specified dispensing control information items depending at least in part on the washing and/or cleaning information item obtained is understood to mean that at least one of the specified dispensing control information items is adjusted depending on a measurement value comprised in the washing and/or cleaning information item (e.g., in the event of an absolute and/or relative deviation of the value from a specified value). The adjustment may be performed for example according to an algorithm for optimising the dispensing control information items. Such an algorithm may be for example an algorithm for machine self-learning, such as an algorithm which is applied by an artificial neural network and/or a support vector machine.

The adjustment of the at least one specified dispensing control information items may be carried out for example by the dispensing module. This is practical for example when information representing the multiplicity of specified dispensing control information items kept available by the dispensing module.

Alternatively or additionally, the adjustment of the at least one specified dispensing control information items may be carried out by the server apparatus. For example, the dispensing module may send the washing and/or cleaning information item to the server apparatus and/or cause the washing and/or cleaning information item to be sent to the server apparatus. For example, the washing and/or cleaning information item from the dispensing module may be received at the server apparatus, and the at least one specified dispensing control information item may be adjusted by the server apparatus depending at least in part on the washing and/or cleaning information item. The server apparatus then sends the adjusted dispensing control information item to the dispensing module, for example.

The washing and/or cleaning information item is sent to the server apparatus for example via a communication interface of the dispensing module. The idea of causing the washing and/or cleaning information item to be sent is understood for example to mean that the dispensing module addresses an external communication interface to cause the washing and/or cleaning information item to be sent to the server apparatus via the external communication interface. For example, the washing and/or cleaning information item is received at the server apparatus by a communication interface of the server apparatus. The adjusted dispensing control information item is also sent to the dispensing module via a communication interface of the server apparatus.

According to an exemplary embodiment according to the first aspect of the present disclosure, causing the determination of the dispensing control information item comprises sending the reservoir information item and/or causing it to be sent to the server apparatus from the dispensing module, and receiving the dispensing control information item from the server apparatus at the dispensing module.

For example, the reservoir information item is sent to the server apparatus via a communication interface of the dispensing module, and the dispensing control information item is received by the server apparatus via this communication interface. Causing the reservoir information item to be sent is understood to mean for example that the dispensing module addresses an external communication interface to cause the reservoir information item to be sent to the server apparatus via the external communication interface.

According to an exemplary embodiment according to the first aspect of the present disclosure, the dispensing module is a mobile and/or portable apparatus and/or an apparatus other than a washing or cleaning machine. The term mobile and/or portable apparatus is understood to mean for example an apparatus whose external dimensions are smaller than 30 cm×30 cm×30 cm, preferably smaller than 15 cm×15 cm×15 cm. An apparatus other than a washing or cleaning machine is for example an apparatus which has no functional connection to the washing or cleaning machine and/or does not constitute a part which is permanently connected to the washing or cleaning machine. For example a mobile and/or portable apparatus other than a washing or cleaning machine is understood to mean an apparatus which is introduced (e.g., placed) in the washing and/or cleaning region of the washing and/or cleaning machine (e.g., in the washing drum of a washing machine) for the duration of a washing and/or cleaning process. One example of such a mobile and/or portable apparatus other than a washing or cleaning machine is a dosing aid, which is placed in the washing drum of a washing machine before the start of the washing process and/or a dosing device which is placed in the washing drum of a washing machine before the start of the washing process. For example, the dispensing module is a part of such a dosing aid and/or such as dosing device according to the first aspect of the present disclosure.

According to a third aspect of the present disclosure, a method is disclosed which comprises the steps of a method according to the first aspect of the present disclosure and the steps of a method according to the second aspect of the present disclosure.

Further, according to the third aspect of the present disclosure a system is disclosed which comprises a dispensing module according to the first aspect of the present disclosure and a server apparatus according to the second aspect of the present disclosure.

The individual embodiments and variants of the method according to the first and the second aspects of the present disclosure, of the dispensing module according to the first aspect of the present disclosure, of the server apparatus according to the second aspect of the present disclosure, of the computer program according to the first and second aspects of the present disclosure and of the system according to the third aspect of the present disclosure, and the individual features of said embodiments and variants as disclosed in the preceding text are also to be considered disclosed in all technically practical combinations with each other.

Moreover, the embodiments and variants described above are to be understood as purely exemplary in nature and not as limiting of the present disclosure in any way.

Further advantageous exemplary embodiments of the present disclosure may be discerned from the following detailed description of several exemplary embodiments of the present disclosure, particularly in conjunction with the figures. However, the figures are intended solely for illustrative purposes, not to define the scope of protection of the disclosure. The figures are not true to scale and are intended solely to represent the general concept of the present disclosure for exemplary purposes. In particular, features contained in the figures are in no way to be considered essential components of the present disclosure.

BRIEF DESCRIPTION OF THE DRAWINGS

The present disclosure will hereinafter be described in conjunction with the following drawing figures, wherein like numerals denote like elements, and.

DETAILED DESCRIPTION

The following detailed description is merely exemplary in nature and is not intended to limit the disclosure or the application and uses of the subject matter as described herein. Furthermore, there is no intention to be bound by any theory presented in the preceding background or the following detailed description.

Figure 1:
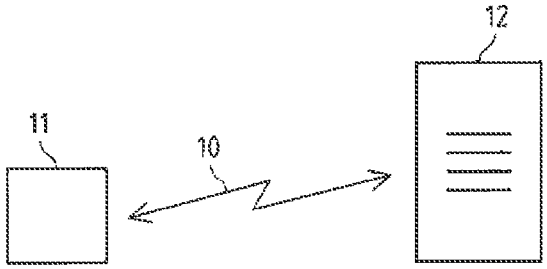
FIG. 1 is a schematic representation of an exemplary embodiment of a system according to the third aspect of the present disclosure.

FIG. 1 represents an exemplary system according to the third aspect of the present disclosure, comprising a dispensing module 11 and a server apparatus 12. The dispensing module 11 is shown in FIG. 1 is in the form of a mobile dispensing module for dispensing detergent and/or cleaning agents. Alternatively, the dispensing module 11 may also be embodied as a stationary dispensing module.

The dispensing module 11 and the server apparatus 12 may communicate for example across the communication link 10. The communication link 10 is for example a connection according to a wireless communication technology. For example, the communication link 10 is a communication link according to a mobile telephony technology. Of course, the communication link 10 may alternatively also be connected by wire. Of course the communication link 10 may also include wire-connected and wireless segments, for example in any number and order.

Figure 2A:
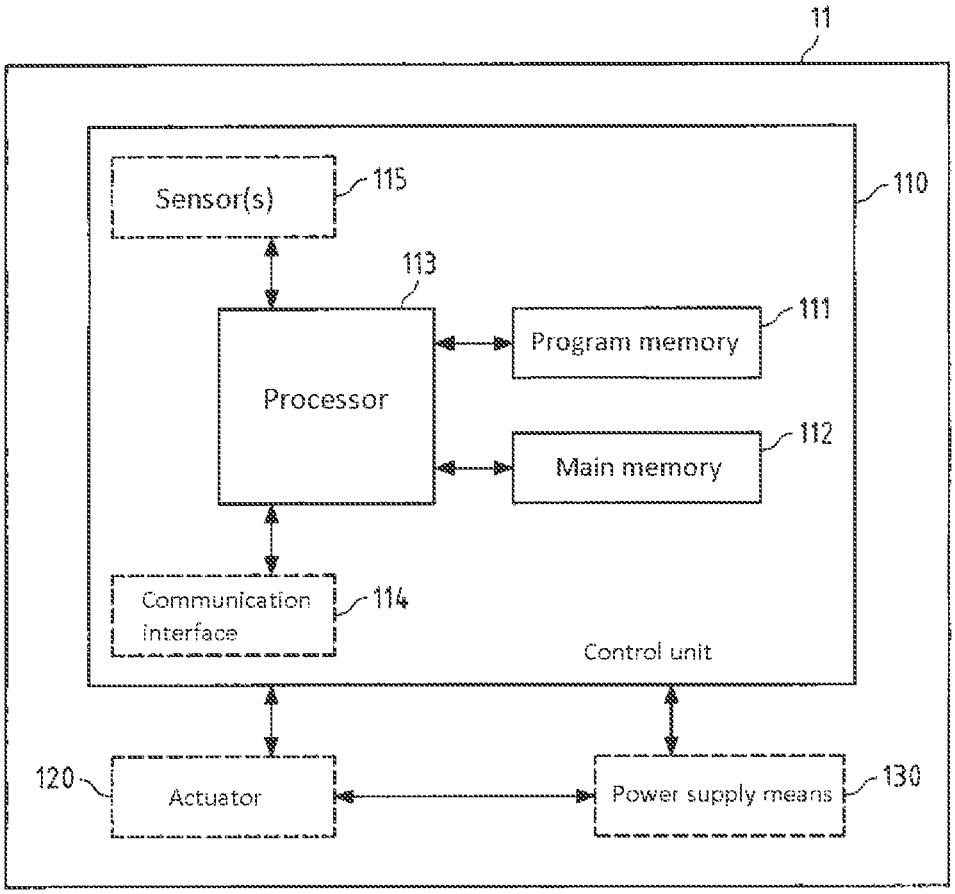
FIG. 2*a* is a block diagram of an exemplary embodiment of a dispensing module according to the first aspect of the present disclosure.

FIG. 2*a* shows a block diagram of an exemplary embodiment of the dispensing module 11. The dispensing module 11 comprises a control unit 110, an actuator 120 and a power supply feature 130.

The control unit 110 comprises at least one processor 113, a program memory 111, a main memory 112, an optional communication interface 114 and one or more optional sensors 115.

The processor 113 is in particular in the form of a Microprocessor, microcontrol unit, microcontroller, digital signal processor (DSP), application-specific integrated circuit (ASIC), or field programmable gate array (FPGA). Of course, the dispensing module 11 may also comprise multiple processors 113.

Processor 113 executes software instructions which are stored in program memory 111, and stores for example intermediate results or the like in working or main memory 112. Program memory 111 is for example a non-volatile memory such as a flash memory, a magnetic memory, an EEPROM memory (electrically erasable programmable read-only memory), and/or an optical memory. Main memory 112 is for example a volatile or non-volatile memory, particularly a random access memory (RAM) such as a static RAM memory (SRAM), a dynamic RAM memory (DRAM), a ferroelectrical RAM memory (Fe-RAM), and/or a magnetic RAM memory (MRAM).

Figure 4A:
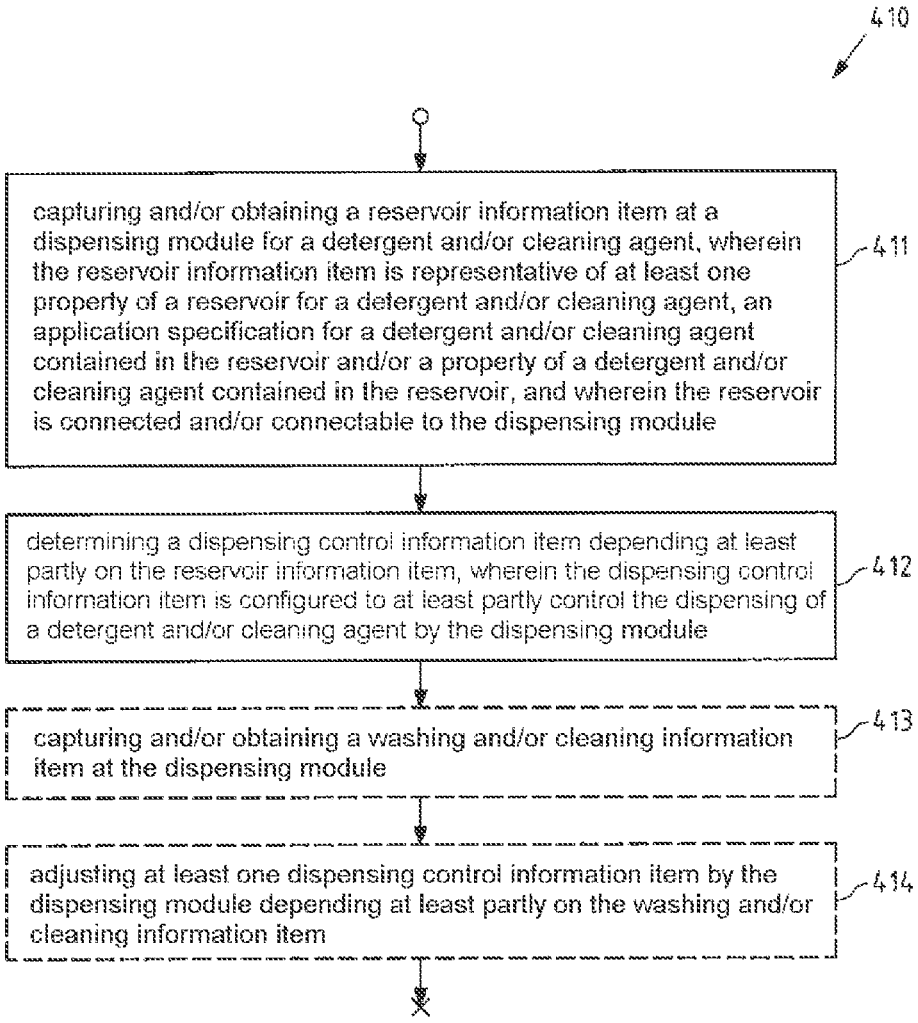
FIG. 4*a* is a flowchart of an exemplary embodiment of a method according to the first aspect of the present disclosure.
Figure 4B:
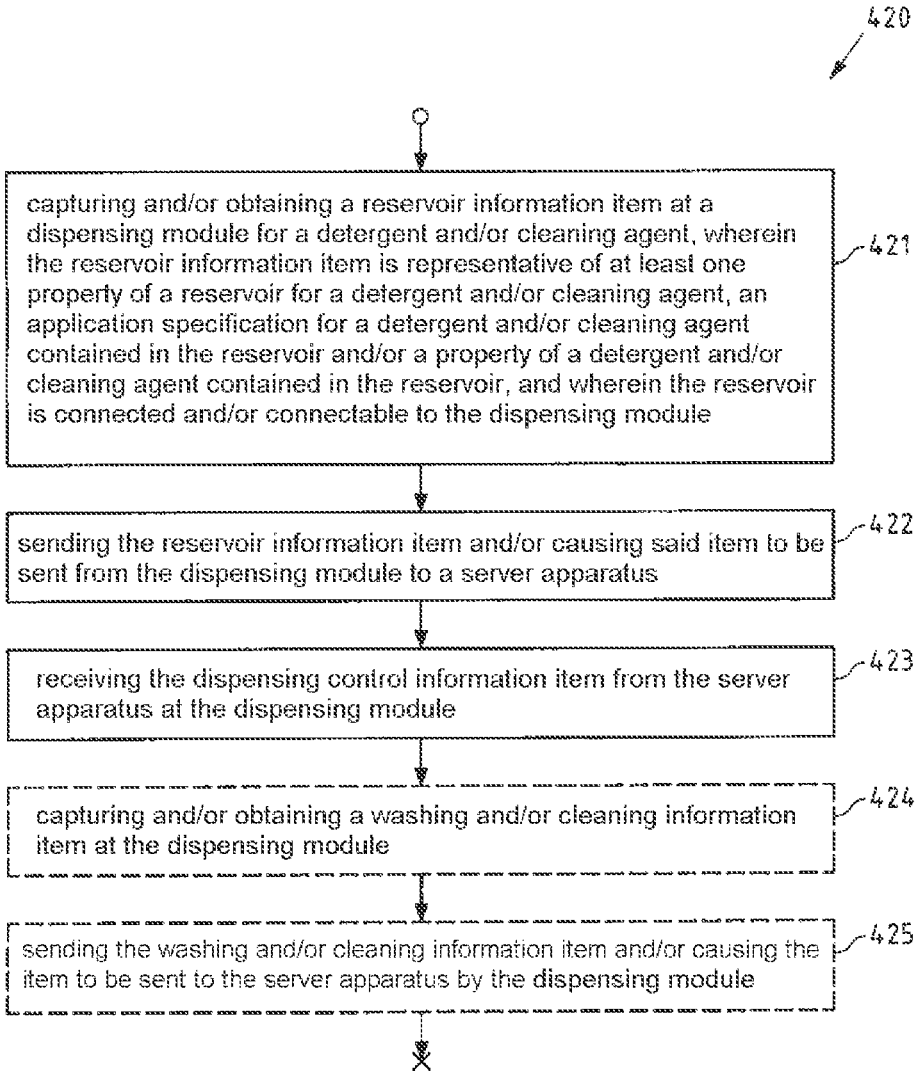
FIG. 4*b* is a flowchart of a further exemplary embodiment of a method according to the first aspect of the present disclosure.

Program memory 111 contains for example software instructions of a computer program according to the first aspect of the present disclosure, comprising software instructions which cause the processor 113 to execute the method according to the first aspect of the present disclosure (e.g., the method according to the flowcharts 410 and 420 represented in FIGS. 4*a* and 4*b*) and/or control when the processor 113 executes these software instructions stored in program memory 111. Further information may also be stored in program memory 111, for example reservoir information and/or dispensing control information.

Program memory 111 is preferably a local data carrier which is permanently connected to the dispensing module 11. Data carriers permanently connected to the dispensing module 11 are for example hard disks which are installed in the dispensing module 11. Alternatively, the data carrier may also be for example a data carrier which is detachably connected to the dispensing module 11, such as a memory stick, a removable storage device, a portable hard disk, a CD, a DVD and/or a diskette.

Program memory 111 contains for example the operating system of the dispensing module 11, which is loaded at least partly into main memory 112 when the dispensing module 11 is started and is then executed by the processor 113. In particular, at least a part of the core of the operating system is loaded into the main memory 112 and executed by the processor 113 when the dispensing module 11 is started. Examples of an operating system are a Windows, UNIX, Linux, Android, Apple iOS and/or MAC operating system.

The operating system in particular enables the dispensing module 11 to be used for processing data. For example, it manages resources such as program memory 111 and main memory 112, communication interface 114 and sensor 115, makes basic functions available to other computer programs via programming interfaces, for example, and controls the execution of computer programs.

Program memory 111 and main memory 112 may also be configured as one memory. Alternatively, program memory 111 and/or main memory 112 may each include several memories. And program memory 111 and/or main memory 112 may also be part of the processor 113.

Processor 113 controls the optional communication interface 114. The communication interface 114 is for example a communication interface according to a wire-connected and/or a wireless communication technology. An example of a wireless communication technology is a local wireless network technology such as Radio Frequency Identification (RFID) and/or Near Field Communication (NFC) and/or Bluetooth (e.g., Bluetooth Version 2.1 and/or 4.0) and/or Wireless Local Area Network (WLAN). RFID and NFC are specified for example according to ISO standards 18000, 11784/11785 and ISO/IEC standards 14443-A and 15693. The Bluetooth specifications are currently available on the internet at www.bluetooth.org. WLAN is specified for example in the IEEE-802.11 family of standards. A further example of a wireless communication technology is a regional wireless network technology such as for example a mobile phone technology, for example Global System for Mobile Communications (GSM) and/or Universal Mobile Telecommunications System (UMTS) and/or Long Term Evolution (LTE). The GSM, UMTS and LTE specifications are maintained and developed by the 3rd Generation Partnership Project (3GPP) and are currently available on the internet at www.3gpp.com and elsewhere. Examples of a wired communication technology are a Local Area Network (LAN) and/or a bus system, for example a Controller Area Network bus (CAN-Bus) and/or a Universal Serial Bus (USB). CAN bus is specified for example according to the ISO standard ISO 11898. The USB specifications are currently available on the internet at www.usb.org. LAN specified in the standards of the IEEE-802.3 family, for example.

For example, the communication interface 114 is a mobile telephony interface which is configured to create a wireless communication link (e.g., communication link 10) with other apparatuses (e.g., with server apparatus 12) and to communicate with them. Alternatively or additionally, the communication interface 114 is configured for example to capture and/or read out one or more information items (e.g., one or more reservoir information items), to receive one or more information items according to a wire-connected and/or wireless communication technology, and/or to send one or more messages according to a wire-connected and/or wireless communication technology (e.g., one or more reservoir information items, one or more dispensing control information items and/or one or more washing and/or cleaning information items).

The dispensing module 11 comprises one or more optional sensors 115. Examples of a sensor 115 are a mechanical sensor (e.g., a pressure sensor) and/or an optical sensor (e.g., a CCD sensor).

In the following text, it is assumed for exemplary purposes that the dispensing module 11 comprises an optical sensor as optional sensor 115 for capturing the reservoir information of a reservoir. Besides the optical sensor, the dispensing module may comprise a light generating features (e.g., one or more LEDs) to support the capture of the reservoir information of a reservoir by the sensor 115.

Of course, the dispensing module 11 may also comprise other sensors in addition or alternatively thereto.

The actuator 120 is controlled for example by the processor 113 of the control unit 110. For example, the processor 113 actuates the actuator 120. For example, the processor 113 actuates the actuator 120 in such manner that the actuator 120 is caused to move, for example to cause dispensing of a detergent and/or cleaning agent.

The optional power supply feature 130 is for example a battery, a capacitor and/or a rechargeable battery.

The components 111-115 of the control unit 110 of the dispensing module 11 are connected to enable them to communicate with each other for example via one or more bus systems (e.g., one or more serial and/or parallel bus connections).

The control unit 110, the actuator 120 and/or the power supply feature 130 are connected to enable them to communicate with each other for example via one or more bus systems (e.g., one or more serial and/or parallel bus connections). For example, one or more components of the control unit 110 are each connected to the actuator 120 and/or to the power supply feature 130 connected.

Of course, the control unit 110 may comprise additional components in addition to the components 111-115. Alternatively or additionally, the dispensing module 11 may comprise further components as well as the control unit 110, the actuator 120 and the power supply feature 130.

Figure 2B:
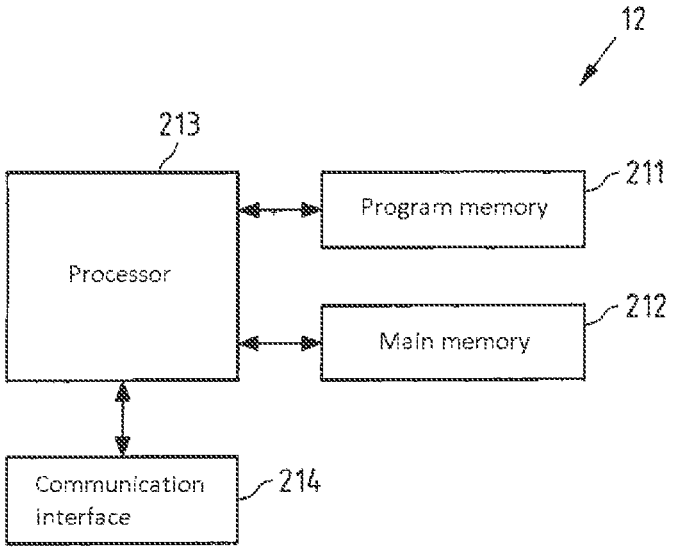
FIG. 2*b* is a block diagram of an exemplary embodiment of a server apparatus according to the second aspect of the present disclosure.

FIG. 2*b* shows a block diagram of an exemplary embodiment of the server apparatus 12 and comprises at least one processor 213, a program memory 211, a main memory 212, and/or a communication interface 214.

Processor 213 executes software instructions which are stored in program memory 211, and stores for example intermediate results or the like in main memory 212. The program memory 211 contains for example software instructions of a computer program according to the second aspect of the present disclosure, comprising software instructions that cause the processor 213 to execute and/or control the method according to the second aspect of the present disclosure (e.g., the method according to the flow diagram 500 represents in FIG. 5) when the processor 213 executes these software instructions stored in program memory 211.

Program memory 211 further contains for example the operating system of the server apparatus 12, which is at least partly loaded into main memory 212 and executed by the processor 213 when the server apparatus 12 is started.

Main memory 212 and program memory 211 may also be configured as one memory. Alternatively, main memory 212 and/or program memory 211 may each include several memories. And main memory 212 and/or program memory 211 may also be part of the processor 213.

Processor 213 controls the communication interface 214, which is embodied for example as a wireless communication interface, for example a communication interface according to a mobile telephony technology. The communication interface 214 is in particular configured to create a wireless communication link (e.g., communication link 10) to connect the server apparatus 12 to other apparatuses (e.g., with dispensing module 11) and enable it to communicate with them.

The components 211-214 of the sensor apparatus 12 are connected to each other for communication purposes for example via one or more bus systems (e.g., one or more serial and/or parallel bus connections).

Of course, the server apparatus 12 may comprise other components besides the components 211-214.

Figure 3:
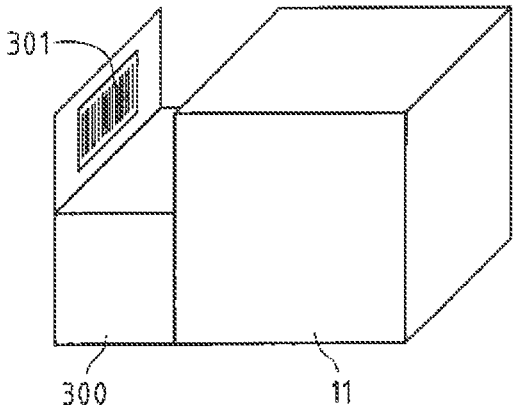
FIG. 3 is a schematic representation of an exemplary embodiment of a reservoir.

FIG. 3 shows an exemplary reservoir 300 which is constructed to accommodate detergents and/or cleaning agents. The reservoir 300 is of dimensionally stable construction for the purpose of the example. For the purposes of the example, the reservoir 300 is connected detachably to the dispensing module 11. The connection between reservoir 300 and dispensing module 11 may for example be separated non-destructively. Alternatively or additionally, the dispensing module 11 and the reservoir 300 may be permanently connected to each other.

The reservoir 300 serves as the site for a pattern 301. In the example of FIG. 3, the pattern 301 has the form of a barcode located in a subarea of the reservoir 300. A barcode is an example of a pattern which can be captured optically. Of course, other patterns which can be captured optically might also be used instead of a barcode. Further examples of a pattern which can be captured optically are sequences of letters and/or digits, geometric patterns, barcodes, quick response codes (QR codes), and/or 2D codes.

The pattern 301 is arranged on the reservoir 300 in the form of a label for the purposes of the example. Alternatively or additionally, the pattern 301 may also be a part of the reservoir 300 and/or printed on the reservoir 300. For example, the pattern 301 may also be realised at one or more additional and/or other, e.g., predetermined or not predetermined positions on the reservoir 300.

The pattern 301 provides an item of reservoir information, for example.

As was disclosed earlier, the reservoir information item represents for example a characterizing property of the reservoir 300. Characterizing for a property of a reservoir 300 is for example an item of information which represents and/or contains one or more indicators relating to a maximum date of use of the reservoir 300, regarding the spatial configuration of the reservoir 300, regarding a volume and/or fill quantity of the reservoir 300 and/or for identifying the reservoir 300 or the type of the reservoir 300.

The reservoir information item may also represent an application specification for a detergent and/or cleaning agent contained in the reservoir 300. Such an application specification contains and/or represents for example one or more indicators regarding a dosage of the detergent and/or cleaning agent recommended for a given application. An item of reservoir information that represents an application specification for a detergent and/or cleaning agent contained in the reservoir 300 may also be understood to be information which identifies the dispensing control information and/or represents and/or contains at least a part of the dispensing control information.

Alternatively or additionally, as disclosed previously the reservoir information item may represent a property of a detergent and/or cleaning agent contained in the reservoir 300. Characterizing of a property of a detergent and/or cleaning agent contained in a reservoir is for example an information item which represents or contains one or more indicators regarding a chemical and/or physical property of the detergent and/or cleaning agent, regarding the type of the detergent and/or cleaning agent and/or for identifying the detergent and/or cleaning agent. The chemical and/or physical property is for example a chemical and/or physical composition of the detergent and/or the aggregate state of the washing and/or cleaning agent (e.g., solid, liquid or gaseous). The type of he detergent and/or cleaning agent specifies for example whether it is a detergent which contains bleach, a mild detergent, a detergent for coloured fabrics, a disinfectant, a machine-dishwashing detergent and/or another type of detergent and/or cleaning agent, and/or what ingredients and/or structural composition the detergent and/or cleaning agent contains.

In the following text, it is assumed for the purposes of the example that the barcode (e.g., in encoded form) represented in FIG. 3 as an example of a pattern 301 which can be captured optically provides at least one indicator for identifying the detergent and/or cleaning agent contained in the reservoir 300 as an item of reservoir information. For example, this indicator may be an identifier for identifying the detergent and/or cleaning agent such as a product name and/or a product number.

FIG. 4*a* shows a flow diagram 410 of an embodiment of a method according to the first aspect of the present disclosure. In the following text, it is assumed for the purposes of the example that the steps 411 to 414 of the flow diagram 410 are executed by the dispensing module 11 in the system 1 of FIG. 1.

In a step 411, an item of reservoir information is captured by the sensor 115 of the dispensing module 11. The item of reservoir information captured in step 411 is stored and/or stored temporarily for example in the program memory 111 and/or in the main memory 112 of the dispensing module 11.

Of course, one or more further items of reservoir information may be captured and/or obtained in step 411 (e.g., reservoir information items from other reservoirs 300, connected with the dispensing module 11, for example).

In the following text, it is assumed for the purposes of the example that the reservoir information item captured in step 411 is the reservoir information item provided by the pattern 301 on the reservoir 300 which can be captured optically. However, the present disclosure is not limited to patterns which can be captured optically. Alternatively or additionally, the reservoir information may also be provided for example in the form of a pattern on a reservoir which can be captured mechanically and/or via a communication interface of the reservoir.

In a step 412, a dispensing control information item is determined by the dispensing module 11, which is configured to at least partly control the dispensing of a detergent and/or cleaning agent by the dispensing module 11. For example, the dispensing control information item is determined by the processor 113 of the dispensing module 11.

In step 412, for example, the dispensing control information item is selected from a multiplicity of prescribed dispensing control information items for example depending at least partly on the reservoir information captured in step 411. The selection may be made for example according to predefined rules of determination and/or selection, which assign a determined dispensing control information item to a determined reservoir information item (or a determined combination of reservoir information items). A representation of the multiplicity of prescribed dispensing control information items and/or of the rules for determination and/or selection is stored for example in the program memory 111 of the dispensing module 11 as a table representation.

In such a table, for example various dispensing control information item may be assigned to information for identifying a detergent and/or cleaning agent (e.g., various product numbers and/or product names) and/or determined combinations of information for identifying a detergent and/or cleaning agent. If the reservoir information item captured in step 111 contains and/or represents such information for identifying the detergent and/or cleaning agent contained in the reservoir 300, in step 412 for example the dispensing control information item is determined that has been assigned to this information for identifying a detergent and/or cleaning agent in the table.

Of course, in step 412 the dispensing control information item may also be determined (e.g., calculated) in another way, at least partly depending on the reservoir information item.

The dispensing control information item prescribes one or more dispensing parameters, for example. For example, these are dispensing parameters of the dispensing module 11. Examples of a dispensing parameter are a dispensing quantity, a dispensing time and/or a dispensing duration. For example, a dispensing parameter prescribes a dispensing quantity, a dispensing time and/or a dispensing duration for the dispensing of detergents and/or cleaning agents by the dispensing module 11.

For example, the dispensing module 11 is configured to dispense and/or cause dispensing of the detergent and/or cleaning agent contained in the reservoir 300 in accordance with the dispensing parameters prescribed by the dispensing control information item determined in step 411 when the reservoir 300 is connected to the dispensing module 11. For example, the control unit 110 of the dispensing module 11 is configured to control the actuator 120 of the dispensing module 11 in such manner that the detergent and/or cleaning agent is dispensed in accordance with the dispensing parameters prescribed by the dispensing control information item determined in step 411 and/or the dispensing of the detergent and/or cleaning agent contained in the reservoir (e.g., by the reservoir) is caused in accordance with the dispensing parameters prescribed by the dispensing control information item.

In the following text, the optional steps 413 and 414 are described which may be executed optionally for example when the dispensing control information item in step 412 was selected from a multiplicity of prescribed dispensing control information items.

In the optional step 413, a washing and/or cleaning information item is captured and/or received at the dispensing module 11.

The washing and/or cleaning information item represents for example measurement values of one or more physical and/or chemical variables which are characterizing of a washing and/or cleaning process, such as a temperature of the washing and/or cleaning solution, a duration of the washing and/or cleaning process and/or a concentration of detergents and/or cleaning agents in the washing and/or cleaning solution. In the following text, it is assumed for the purposes of the example that the washing and/or cleaning information item is a washing and/or cleaning information item that was captured in the course of a washing and/or cleaning process, during which a detergent and/or cleaning agent was dispensed in accordance with the dispensing control information item determined by the dispensing module in step 412.

The washing and/or cleaning information item is captured for example by a sensor 115 of the dispensing module 11.

Alternatively or additionally, the washing and/or cleaning information item may be captured for example by an external sensor of a washing and/or cleaning machine in which the washing and/or cleaning process takes place, and then communicated to the dispensing module. In this case, the washing and/or cleaning information item is received for example via the communication interface 114 of the dispensing module 11.

In the optional step 414, at least the dispensing control information item determined in step 412 is adjusted to the multiplicity of prescribed dispensing control information items depending at least in part on the washing and/or cleaning information item captured and/or obtained in step 413.

For example, the dispensing control information item determined in step 412 is adjusted to the multiplicity of prescribed dispensing control information items depending at least in part on a measurement value included in the washing and/or cleaning information item (e.g., in the event of an absolute and/or relative deviation of the value from a prescribed value). A representation of the adjusted dispensing control information item is then stored for example in the program memory 111 of the dispensing module 11 as part of the representation of the multiplicity of prescribed dispensing control information items. The adjustment may be made for example according to an algorithm for optimising the dispensing control information items. Such an algorithm may be for example an algorithm for machine self-learning, such as an algorithm which is applied by an artificial neural network and/or a support vector machine.

For example, if the concentration of a detergent and/or cleaning agent in the washing and/or cleaning solution captured in step 413 is lower (or higher) than a prescribed concentration, in step 414 for example the dispensing quantity of the dispensing control information item determined in step 412 may be adjusted to the multiplicity of prescribed dispensing control information items in such manner that the specification of the dispensing quantity is raised (or lowered). In this way, it is possible to bring about an increase (or reduction) in the concentration of the detergent and/or cleaning agent in der washing and/or cleaning solution for future washing and/or cleaning processes during which a detergent and/or cleaning agent will be dispensed in accordance with this (now adjusted) dispensing control information item.

FIG. 4*b* shows a flow diagram 420 of a further embodiment of a method according to the first aspect of the present disclosure. In the following text, it is assumed for the purposes of the example that the steps 421, 422 and 423 and the optional steps 424 and 425 of the flow diagram 420 are executed by the dispensing module 11 in the system 1 of FIG. 1.

In a step 421, a reservoir information item is captured and/or obtained at a dispensing module 11. Step 421 corresponds to step 411 of FIG. 4*a*, for example.

The steps 422 and 423 of FIG. 4*b* described hereafter are exemplary for effecting the determination of a dispensing control information item by the dispensing module 11. For example, the dispensing control information item is determined by an apparatus (e.g., the server apparatus 12) other than the dispensing module 11.

In step 422, the reservoir information item captured and/or obtained at the dispensing module 11 in step 421 is sent to the server apparatus 12 by the dispensing module 11. For example, the reservoir information item is sent to the server apparatus 12 by the communication interface 114 of the dispensing module 11 (e.g., via the communication link 10).

Alternatively or additionally, in step 422 the dispensing module may cause the reservoir information item to be sent to the server apparatus 12. For example, the dispensing module 11 addresses an external communication interface to cause the reservoir information item to be sent to the server apparatus 12 by the external communication interface.

In step 423, a dispensing control information item from the server apparatus 12 which is configured to at least partly control the dispensing of a detergent and/or cleaning agent by the dispensing module 11 is then received at the dispensing module 11. For example, the dispensing control information item is received by the dispensing module 11 via the communication interface 114. As disclosed earlier in step 412 of the flow diagram 410, the dispensing control information item for example specifies one or more dispensing parameters.

In an optional step 424, a washing and/or cleaning information item captured and/or obtained at the dispensing module 11. Step 424 corresponds for example to optional step 413 of flow diagram 410.

In an optional step 425, the washing and/or cleaning information item captured and/or obtained in step 424 is sent to the server apparatus 12 by the dispensing module 11. For example, the washing and/or cleaning information is sent to the server apparatus 12 by the communication interface 114 of the dispensing module 11 (e.g., via the communication link 10).

Alternatively or additionally, the dispensing module 11 causes the washing and/or cleaning information item to be sent to the server apparatus 12 in optional step 425. For example, the dispensing module 11 instructs an external communication interface, to cause the washing and/or cleaning information item to be sent to the server apparatus 12 by the external communication interface.

Figure 5:
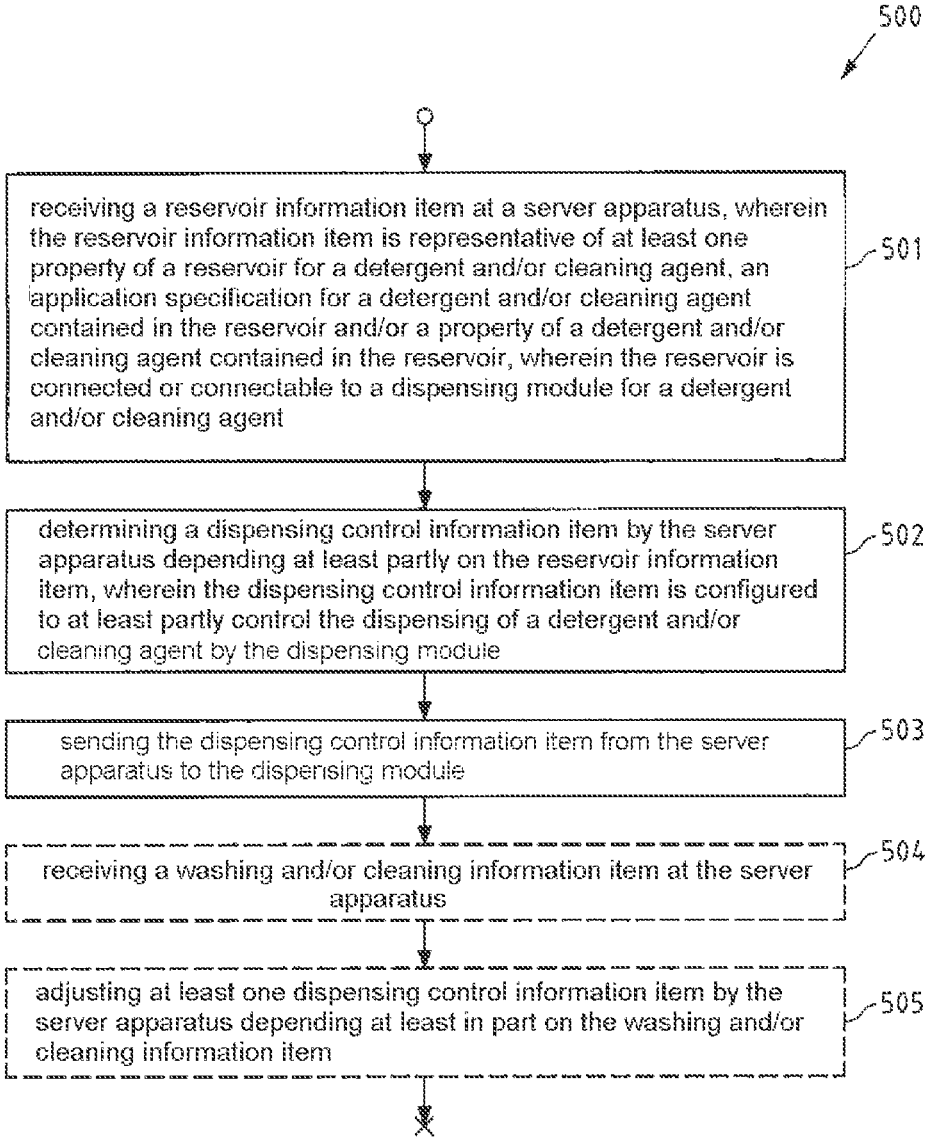
FIG. 5 is a flowchart of an exemplary embodiment of a method according to the second aspect of the present disclosure.

FIG. 5 shows a flow diagram 500 of an embodiment of a method according to the second aspect of the present disclosure. In the following text, it is assumed for the purposes of the example that steps 501-505 of the flow diagram 500 are executed in the system 1 of FIG. 1 by the server apparatus 12. For example, at least steps 501-503 are carried out after step 422 of flow diagram 420. For example, at least steps 501-503 are caused by the sending of the reservoir information item.

In a step 501, a reservoir information item is received at the server apparatus 12. For example, the reservoir information item is received via the communication interface 214 of the server apparatus 12 (e.g., via the communication link 10 from the dispensing module 11). The reservoir information items received in step 501 is for example the reservoir information item which was sent to the server apparatus 12 in step 422 of the flow diagram 420.

The reservoir information item received in step 501 is stored for example in the program memory 211 and/or in the main memory 212 of the server apparatus 12. Multiple reservoir information items may also be received in step 501, for example.

In a step 502, the dispensing control information item is determined depending at last in part on the reservoir information item received in step 501. The determination in step 501 corresponds for example to the determination disclosed previously for step 412 of the flow diagram, with the difference that the server apparatus 12 (e.g., the processor 213 of the server apparatus 12) carries out the determination instead of the dispensing module. Accordingly, the representation of the multiplicity of prescribed dispensing control information items and/or of the rules for determination and/or selection is stored as a table representation for example in the program memory 211 of the server apparatus 12.

In a step 503, the dispensing control information item is sent to the dispensing module 11 by the server apparatus 12. For example, the dispensing control information item is sent to the dispensing module 11 via the communication interface 214 of the server apparatus 12 (e.g., via the communication link 10).

In the following text, the optional steps 504 and 505 are described, which are executed optionally for example when the dispensing control information item in step 502 has been selected from a multiplicity of prescribed dispensing control information items.

In the optional step 504, a washing and/or cleaning information item is received at the server apparatus 12. For example, the washing and/or cleaning information item is received by the communication interface 214 of the server apparatus 12 (e.g., via the communication link 10 from the dispensing module 11). The washing and/or cleaning information item received in step 501 is for example the reservoir information item sent to the server apparatus 12 in step 425 of flow diagram 420.

In the optional step 505, at least the dispensing control information item determined in step 502 is adjusted to the multiplicity of the prescribed dispensing control information items depending at least partly on the washing and/or cleaning information item received in step 504. The adjustment in step 505 corresponds for example to the adjustment disclosed earlier for step 414 of flow diagram 400 with the difference that the server apparatus 12 (e.g., the processor 213 of the server apparatus 12) carries out the adjustment instead of the dispensing module.

One advantage of the present disclosure is for example the capability to dispense the detergent and/or cleaning agent contained in the reservoir 300 with temporal separation and in the calculated quantity. In this way, for example not only is the cleaning result improved, but the consumption of both energy and detergent and/or cleaning agent is minimised. Moreover, at the same time an optimal cleaning result is enabled for example despite the reduced consumption of detergent and/or cleaning agent. The reservoirs 300 may also be combined freely, for example. And for example the washing and/or cleaning chemistry can be adapted freely to the washing and/or cleaning process. For example, the dosing at the correct time with the correct quantity of detergent and/or cleaning agent is guaranteed, with the result that too much and also too little detergent and/or cleaning agent is never used in a treatment step of a washing and/or cleaning process.

Furthermore, it may also be ensured for example that, unlike the use of a fixed multichamber reservoir an optimal combination of reservoirs is used for a washing and/or cleaning process. Thus for example detergents and/or cleaning agents, machine cleaning agents and/or disinfectants can be combined freely. For example, different dosages are possible without the need to consider that the reservoir would have to be emptied at the same time and/or at the same rate. It is possible to avoid forced emptying of residues, for example, which in turn reduces the consumption of detergent and/or cleaning agent considerably.

Figure 6:
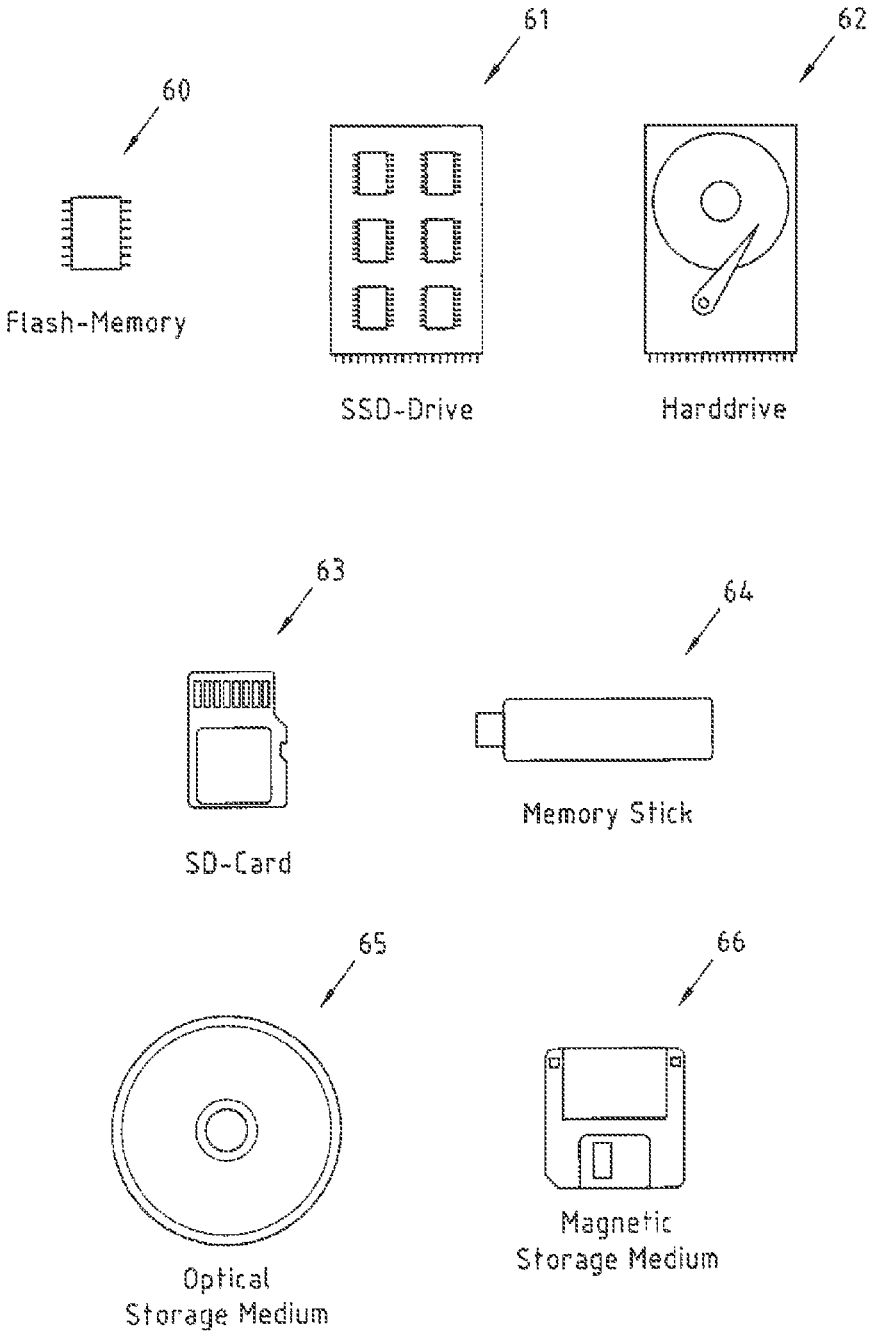
FIG. 6 shows various exemplary embodiments of a storage medium.

FIG. 6 shows various embodiments of storage media on which an embodiment of a computer program as contemplated herein may be stored. The storage medium may be for example a magnetic, electrical, optical and/or other kind of storage medium. The storage medium may be for example part of a processor (e.g., of the processor 113 of FIG. 4 and/or of the processor 213 of FIG. 5), for example a (non-volatile or volatile) program memory of the processor or a part thereof (such as program memory 111 in FIG. 4 and/or program memory 211 in FIG. 5). Embodiments of a storage medium are a flash memory 60, a SSD hard disk 61, a magnetic hard disk 62, a memory card 63, a memory Stick 64 (e.g., a USB stick), a CD-ROM or DVD 65, or a diskette 66.

The embodiments of the present disclosure and the optional features and properties associated with each of said designs as explained in the preceding text are intended to be considered disclosed also in all combinations thereof with each other. In particular, the description of a feature included as part of one embodiment—unless the contrary is explicitly indicated—is not to be construed in the present case as an indispensable or essential feature for the functioning of said embodiment. The sequence of method steps set forth in this specification is not mandatory, alternative sequences of the method steps are conceivable. The method steps may be implemented in various ways, for example an implementation in software (by program instructions), hardware or a combination of the two is conceivable for implementing the method steps.

Terms used in the patent claims such as "comprise", "include", "contain" "have" and the like do not preclude further elements or steps. The formulation "at least in part" includes the notions of both "partly" and "completely". The formulation "and/or" is intended to be construed to mean that both the alternative and the combination are to be disclosed, i.e. "A and/or B" means "(A) or (B) or (A and B)". The use of the indefinite article does not preclude a plurality. A single apparatus may perform the functions of several units and/or apparatuses described in the patent claims. Reference signs appearing in the patent claims are not to be considered as limiting of the means and steps used.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A method comprising the steps of:

receiving, at a dispensing module having a sensor, a reservoir having an information item wherein the reservoir is connected detachably to the dispensing module such that the sensor is aligned with the information item;

capturing the reservoir information item at the dispensing module for a cleaning agent, wherein the reservoir information item is representative of a property of the cleaning agent contained in the reservoir;

capturing a washing information item at the dispensing module wherein the washing information item includes a temperature of a cleaning solution, a duration of a cleaning process and a concentration of cleaning solution in a washing machine;

determining a dispensing control information item in response to the reservoir information item and the washing information item;

sending the reservoir information item and the washing information item from the dispensing module to a server apparatus;

receiving a dispensing quantity, a dispensing time and a dispensing duration for dispensing the cleaning agent from the server apparatus at the dispensing module wherein the dispensing quantity, the dispensing time and the dispensing duration for dispensing the cleaning agent is determined in response to the reservoir information item and the washing information item;

adjusting the dispensing control information in response to the dispensing quantity, the dispensing time and the dispensing duration for dispensing the cleaning agent to generate an adjusted dispensing control information; and controlling a dispensing of the cleaning agent by the dispensing module in response to the adjusted dispensing control information item.

2. The method according to claim 1, wherein the reservoir information item is supplied by the reservoir as a pattern capable of being captured mechanically and/or optically, and wherein the pattern capable of being captured mechanically and/or optically is a part of the reservoir and/or is arranged on the reservoir.

3. The method according to claim 1, wherein the capturing the reservoir information item is assured via a wireless communication interface of the dispensing module chosen from a RFID interface and/or a NFC interface.

4. The method according to claim 1, wherein the reservoir information item is provided via a wireless communication interface of the reservoir chosen from a RFID interface and/or a NFC interface.

5. The method according to claim 1, further comprising:

dispensing and/or causing the dispensing of the cleaning agent by the dispensing module depending at least partly on the dispensing control information item.

6. The method according to claim 5, wherein the dispensing and/or the causing of the dispensing of the cleaning agent only takes place when the reservoir is connected to the dispensing module.

7. The method according to claim 5, wherein the dispensing module comprises a control unit and at least one actuator, wherein the control unit is configured to control the at least one actuator to cause a movement of the at least one actuator with the movement of the at least one actuator causes the cleaning agent to be dispensed.

8. The method according to claim 7, wherein the dispensing module comprises at least one power supply feature, and wherein the at least one power supply feature is configured to supply the at least one actuator and/or the control unit with energy.

* * * * *